United States Patent [19]

Ohnuki

[11] Patent Number: 4,658,232

[45] Date of Patent: Apr. 14, 1987

[54] ELECTROMAGNETIC DEVICE

[75] Inventor: Ichiro Ohnuki, Tokyo, Japan

[73] Assignee: Canon Kabushiki Kaisha, Tokyo, Japan

[21] Appl. No.: 757,690

[22] Filed: Jul. 22, 1985

[30] Foreign Application Priority Data

Jul. 31, 1984 [JP] Japan ..... 59-116121[U]

[51] Int. Cl.[4] ..... H01F 7/08

[52] U.S. Cl. ..... 335/270; 335/228; 335/249; 335/276; 335/279

[58] Field of Search ..... 335/228, 249, 269, 270, 335/271, 272, 276, 277, 279, 274

[56] References Cited

U.S. PATENT DOCUMENTS 3,396,354 8/1968 Fisher ..... 335/249

4,205,287 5/1980 Shimizu et al. ..... 335/277

*Primary Examiner*—E. A. Goldberg

*Assistant Examiner*—Lincoln D. Donovan

*Attorney, Agent, or Firm*—Toren, McGeady & Goldberg

[57] ABSTRACT

An electromagnetic device for use in, for example, the diaphragm control of a camera. The electromagnetic device includes an electromagnet, an armature, an armature shaft and a restricting member for inclining the armature with respect to the armature shaft, whereby even if the armature shaft is not parallel with the attraction face of the electromagnet, holding the armature attraction by the electromagnet is certain.

8 Claims, 14 Drawing Figures

ELECTROMAGNETIC DEVICE

BACKGROUND OF THE INVENTION

1. Field of the Invention

This invention relates to an electromagnetic device for use in, for example, the diaphragm control of a camera.

2. Description of the Prior Art

An example of a conventional device of this kind is shown in FIGS. 1 to 5, including an armature 1, a yoke 2, a pair of coils 3, and an armature shaft 4 with a flange 5 mounted on an armature lever 7. The shaft 4 has a pair of short diameter portions 4*c* on either side of a large diameter portion 4*b* about which the armature 1 is pivotable in the directions of arrows D (see FIG. 2) to allow intimate contact of a reactive surface 1*a* of the armature 1 with attraction surfaces 2*a* of the yoke 2 over the entire area thereof. An E type retainer ring 6 is pressed into an annular groove 4*a* of the shaft 4 after the armature 1 has been installed on the shaft 4. The armature lever 7 is pivotally mounted about a pin (not shown) in a fitted hole 7*a* and is urged by a spring 8, in most cases, in a counterclockwise direction. Reference numeral 9 identifies a charge member, and 10 identifies a member to be driven, for example, identifies diaphragm stop member in the shutter priority camera.

As the spring 8 usually sets the armature lever 7 in the initial or most counterclockwise position where the armature 1 is separated from the yoke 2, after the charge member 9 moves the armature lever 7 in the clockwise direction of arrow A (see FIG. 1) until the armature 1 contacts the yoke 2, when the coils 3 are supplied with current, the electromagnetic force exerted in the yoke 2, despite the return of the charge member 9 to the initial position of FIG. 1, must hold the armature 1 in contact with the yoke 2. In desired timing, the current supplied to the coils 3 is then cut off, permitting the armature lever 7 to turn in a counterclockwise direction by the bias force of the spring 8, whereby the member 10 moves. By the way, in FIG. 2, the reactive surface 1*a* of the armature 1 and the attraction face 2*a* of the yoke 2 show a parallel or ideal relationship. With the electromagnetic device installed in such a relationship, when the armature 1 is brought into mechanical contact with the yoke 2, the reactive surface 1*a* of the armature 1 arrives at the upper and lower edges 2*b* and 2*c* of the yoke 2 simultaneously. Therefore, a stable attraction can be established when the coils 3 are energized.

Due to the tolerances of the parts, however, it is very rare that the spatial relationship of FIG. 2 is set up. In most cases, the plane of the armature lever 7 tilts either clockwise or counterclockwise so that the reactive surface of the armature 1 and the attraction surface 2*a* of the yoke 2 are not parallel with each other as shown in FIGS. 3A and 4A. In FIG. 3A where the axis of the shaft 4 is inclined clockwise from the parallel position with the attraction surface 2*a*, or the distance from the reactive surface 1*a* to the upper edge 2*b* is longer than that to the lower edge 2*c*, when the armature lever 7 is turned clockwise in FIG. 1 (to the left in FIG. 3A), the reactive surface 1*a* first contacts with the lower edge 2*c*, and, as the lever 7 is pushed further, the armature 1 is then pivoted about the edge 2*c* in the direction of arrow B until the reactive surface 1*a* rests on the entire area of the attraction surface 2*a*. Then, when the coils 3 are energized, the armature 1 can be reliably held in the position of FIG. 3B by attraction. It should be noted here that a point G on the axis of the shaft 4 does not shift vertically during the time between before and after the attraction or the positions of FIGS. 3A and 3B. This implies that the armature lever 7 does not distort, because the pivotal arrangement of the armature 1 about the large diameter portion 4*b* of the shaft 4 absorbs the discrepancy of the actual angular position of the lever 7 from the ideal position of FIG. 3A.

In FIG. 4A, on the other hand, the reactive surface 1*a* first contacts with the upper edge 2*b* of the yoke 2. For perfect contact to be established, the armature 1 must then turn about a line 0 perpendicular to the paper (in contact with the upper edge 2*b*) in a clockwise direction of arrow C (see FIG. 4A). But this is not permitted, because the bottom surface 1*b* of the armature 1 rests on the flange 5. As the lever 7 is pushed further, therefore, twisting of the lever 7 takes place, as shown by the difference in the height h of a point G before and after perfect contact is reached or the positions of FIGS. 4A and 4B respectively. The electromagnetic force is generally not strong enough to overcome the recovering force of the twisted lever 7. Therefore, soon after the charge lever 9 has moved away from the lever 7, the armature 1 turns backward about the line 0, assuming the attitude of FIG. 4A with its upper end only in contact with the yoke 2 at the upper edge 2*b*. The resultant attracting state is very unstable so that when any shock takes place, such an imperfect contact will be broken easily.

From the above it will appear that the abovedescribed problem can be solved if all the parts are assembled to one-sided spatial relationships, as typically represented by the position of FIG. 3A by taking into account the tolerances of the parts. Even when the electromagnetic device has such a characteristic, however, when turned upside down (for example, the camera employing it is held with its bottom pointing upward), the position of FIG. 3A turns to a position of FIG. 5, where similar to the position of FIG. 4A, the reactive surface 1*a* contacts only the upper edge of the yoke 2 (or the lower edge 2*c* as viewed in FIG. 3A), and the clockwise movement of the armature 1 about the edge 2*c* is barred by the retainer ring 6.

It should be recognized that if only setting up the armature lever 7 to the clockwise orientation is relied upon, it is impossible to assure proper holding of the armature 1 by the yoke 2 in all angular positions of the electromagnetic device.

An object of the present invention is to provide an electromagnetic device capable of maintaining the attraction in a state stable condition in all angular positions.

SUMMARY OF THE INVENTION

An electromagnetic device includes an electromagnet having an attraction surface, an armature having a reactive surface to be attracted to the attraction surface of the electromagnet, an armature shaft supporting the armature in such a way as to be able to incline with respect to the axis, and a regulating member for inclining the armature with respect to the armature shaft.

DETAILED DESCRIPTION OF THE PREFERRED EMBODIMENTS

Figure 6A:
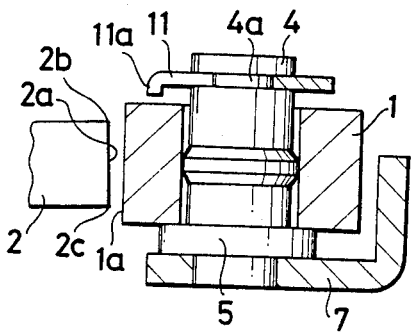
FIGS. 6A and 6B are side sectional views of an embodiment of an electromagnetic device according to the present invention.
Figure 6B:
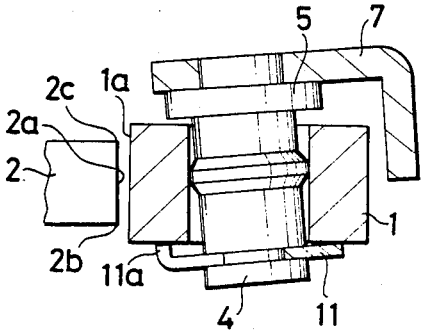

The present invention is next described in conjunction with embodiments thereof. In FIGS. 6A and 6B there is shown an embodiment of the invention in which the same reference numerals have been employed to identify the parts similar to those shown in FIGS. 1 to 5. In this embodiment, as shown in FIG. 6A, the armature lever 7 has been previously inclined clockwise, and an E type snap ring 11 pressed into a groove 4*a* of the armature shaft 4 by utilizing its resilient property. On the lower surface of the ring 11 at the point closest to the electromagnet is formed as a unit a protuberance 11*a* for keeping the armature 2 in an inclined state with respect to the armature shaft 4 so that the upper edge 2*c* as viewed in FIG. 6B does not first contact the reactive surface of the armature 1 when the electromagnetic device is used in the reversed position of FIG. 6B, or, generally speaking, the distance between the attraction surface 2*a* and the reactive surface 1*a* is not short at the upper end and great at the lower end, as viewed from the direction of gravity.

Figure 1:
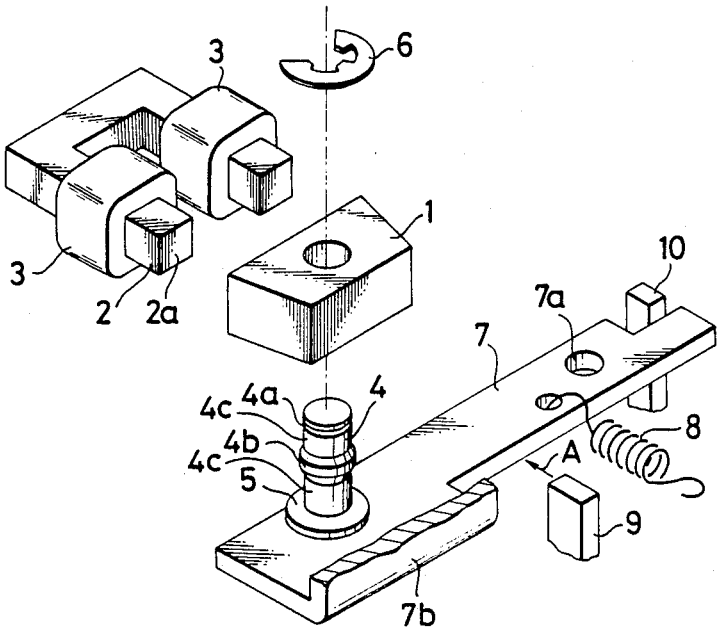
FIG.1 PRIOR ART
FIG. 1 is an exploded perspective view of the conventional electromagnetic device.
Figure 2:
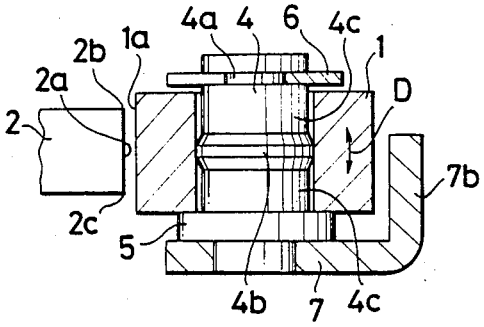
FIG.2 PRIOR ART
FIG. 2 is a side sectional view of the device of FIG. 1 where the armature and the electromagnet are in an ideal spatial relation.
Figure 3A:
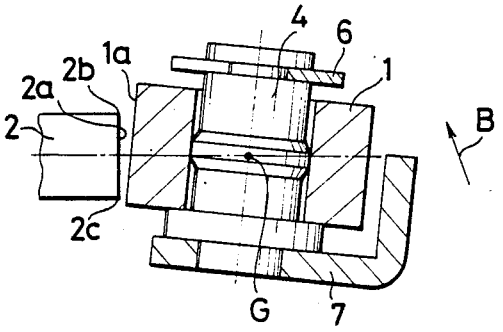
FIG.3A PRIOR ART
FIG. 3A is similar to FIG. 2 except that the armature shaft inclines clockwise.
Figure 3B:
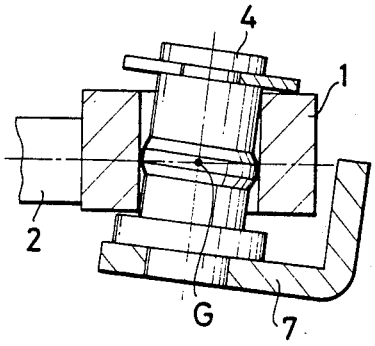
FIG.3B PRIOR ART
FIG. 3B is similar to FIG. 3A except that the contact position is illustrated.
Figure 4A:
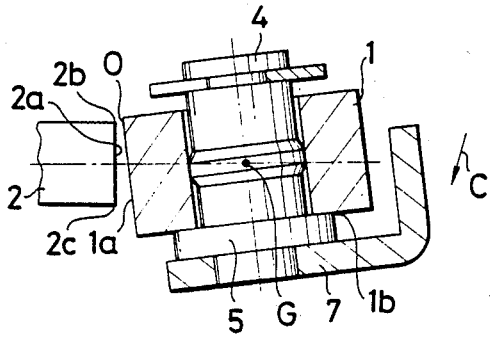
FIG.4A PRIOR ART
FIG. 4A is similar to FIG. 2 except that the armature shaft inclines counterclockwise.
Figure 4B:
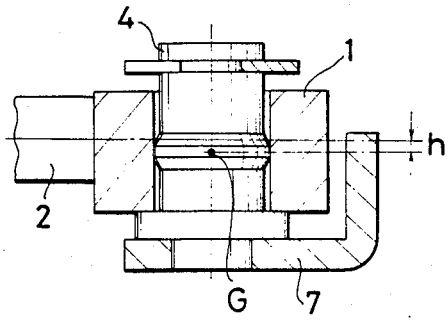
FIG.4B PRIOR ART
FIG. 4B is similar to FIG. 4A except that the contact position is illustrated.
Figure 5:
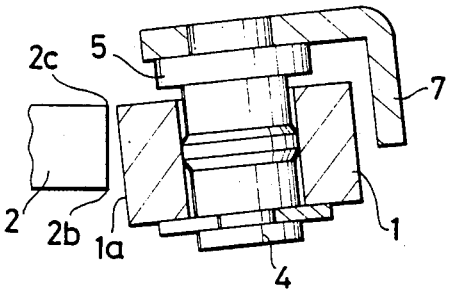
FIG.5 PRIOR ART
FIG. 5 is similar to FIG. 3A except that the reversed position is illustrated.

In the erected position of FIG. 6A, owing to setting of the armature lever 7 in a clockwise inclination, similar to the above-mentioned position of FIG. 3A, the reactive surface 1*a* of the armature 1 first contacts the lower edge 2*c* of the yoke 2. Subsequently, therefore, perfect contact is established to assure stable attraction. In the upside down position of FIG. 6B also, that half of the armature 1 which is nearer to the electromagnet is lifted upward by the protuberance 11*a* of the E type snap ring 11. That is, when reversed in position, the reactive surface 1*a* of the armature 1 is prevented from inclining counterclockwise beyond the parallel position of the attraction surface 2*a* by the protuberance 11*a*. In the reversed position also, it is the lower edge 2*b* of the yoke 2 that the reactive surface 1*a* first contacts. Thus, the electromagnetic device can perform its attracting operation with high reliability no matter what attitude is taken when it is used.

Figure 7A:
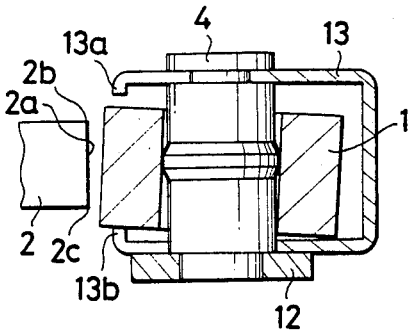
FIG. 7A is a side sectional view of another embodiment of the invention.
Figure 7B:
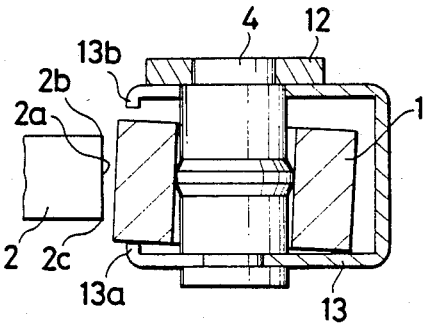
FIG. 7B is similar to FIG. 7A except that the reversed position is illustrated.
Figure 8:
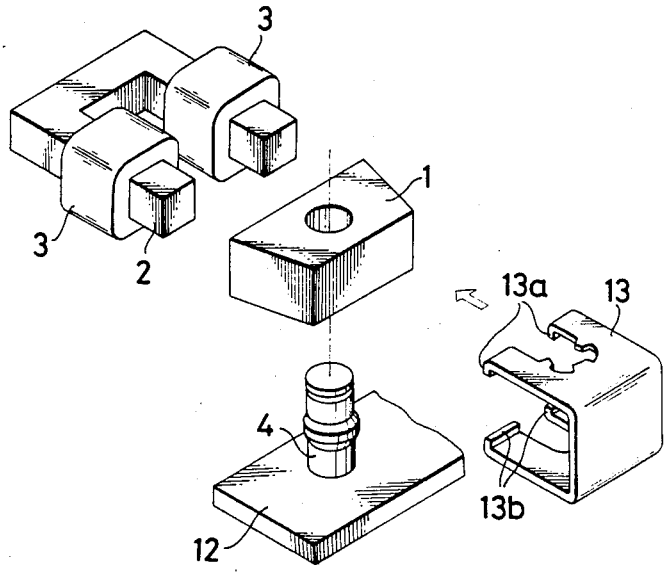
FIG. 8 is an exploded perspective view of the device of FIGS. 7A and 7B.

FIGS. 7A, 7B and 8 illustrate another embodiment of the invention, wherein when assembling the parts, an armature lever 12 is not inclined to any direction, and, therefore, the complete device is assumed to have its armature lever 12 inclined either clockwise or counterclockwise with respect to the direction of gravity, depending on the total sum of the tolerances of the parts used therein. This embodiment is different from the first embodiment of FIGS. 6A and 6B in that a resilient retaining member 13 is provided with two protuberances 13*a* and 13*b* at respective points closest to the electromagnet so that when in the erected position of FIG. 7A, the protuberance 13*b* lifts the armature 1 upward at the side closest to the yoke 2, and when in the upside down position, the other protuberance 13*a* does it. In any case, the inclination of the armature 1 is restricted so that the reactive surface 1*a* does not first contact the upper edge of the yoke 2 (2*b* in FIG. 7A, or 2*c* in FIG. 7B).

According to the embodiments of FIGS. 6A to 8, the E type snap ring 11 or the "U" shaped resilient retaining member 13 is provided with the protuberance 11*a* or the protuberances 13*a* and 13*b* formed as a unit therewith to regulate the inclination of the armature 1 so that the gap between the attraction surface 2*a* of the yoke 2 and the reactive surface 1*a* of the armature 1 is never shorter at the upper end than at the lower end. Because there is no possibility of occurrence contact of the reactive surface 1*a* first with the upper edge of the yoke 2, a stable attracting condition can be established in any angular position.

Figure 9A:
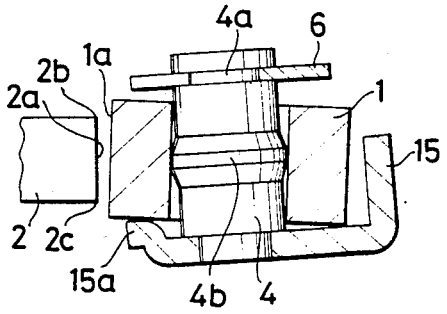
FIG. 9A is a side sectional view of still another embodiment of the invention.
Figure 9B:
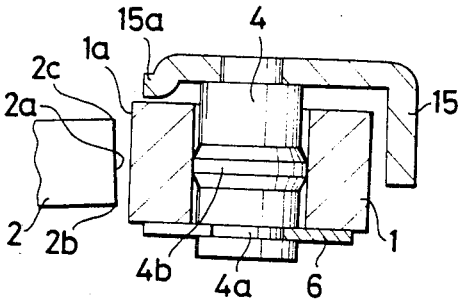
FIG. 9B is similar to FIG. 9A except that the reversed position is illustrated.

FIGS. 9A and 9B illustrate still another embodiment of an invention wherein the armature lever 15 is intentionally inclined counterclockwise as viewed in FIG. 9A, and is provided with a protuberance 15*a* formed as a unit therewith at the nearest side to the electromagnet, so that when the electromagnetic device is used in the erected position of FIG. 9A, the reactive surface 1*a* of the armature 1 and the upper edge 2*b* of the yoke 2 do not first contact each other. In other words, the gap between the attraction surface 2*a* and the reactive surface 1*a* does not become narrower at the upper end and wider at the bottom end.

In the erected position of FIG. 9A, though the armature lever 15 is set up with a counterclockwise inclination, the armature 1 is inclined clockwise by the above identified protuberance 15*a* so that the reactive surface 1*a* of the armature 1 never inclines from the parallel position with the attraction surface 2*a* of the yoke 2 to permit the reactive surface 1*a* to first contact the lower edge 2*c* of the yoke 2. Therefore, the armature 1 can be brought into stable attraction with the yoke 2.

In the reversed position of FIG. 9B, the reactive surface 1*a* of the armature 1 first contacts with the lower edge 2*b* of the yoke 2. Therefore, the stable attracting condition can be established no matter what attitude may be taken when in use.

Though the foregoing embodiments have been described in connection with the unified formation of the protuberance 11*a*, or 13*a* (13*b*), or 15*a* with the E type snap ring 11, 13, or armature lever 15, the protuberance may be formed otherwise as a unit on the upper end of the armature shaft 4, or a regulating member may be solely mounted and used on the armature shaft 4. Also, though the retaining member is in the form of an E type snap ring 11 or 13 utilizing the resilient property as the fastening force, another form may be employed so that fastening accomplished by caulking means.

The present invention is applicable to another type of electromagnetic device in which the yoke is made of permanent magnet. Even in this example of application, a similar advantage to that described in connection with the foregoing embodiments is obtained. It is to be noted in this connection that in this type of electromagnetic device, when the coil is de-energized, the yoke attracts the armature, and when the coil is energized, the attraction of the yoke to the armature is released by the force of a bias spring.

Also, though, in the foregoing embodiments, the attractive surface of the yoke is taken as a reference for regulating the inclination of the armature, the inclination of the yoke may be controlled otherwise in reference to the armature, thereby a similar advantage can be obtained.

As has been described above, according to the present invention, use is made of a regulating member for inclining the armature with respect to the armature shaft so that the gap between the attraction surface of the electromagnet and the surface to be attracted of the armature is wider at the upper end than at the lower end as viewed from the direction in which gravity works, thereby giving an advantage that in any angular position, the armature can be brought into and maintained stable in contact with the electromagnet without producing any stress in the armature shaft and the armature lever.

What is claimed is:

1. An electromagnetic device comprising:

(a) an electromagnet having an attraction surface;

(b) an armature having a reactive surface to be attracted to said attraction surface of said electromagnet;

(c) an armature shaft, having an axis, supporting said armature in such a way as to be able to incline with respect to the axis; and (d) a regulating member for keeping said armature inclined with respect to the axis of said armature shaft, said regulating member keeping said armature inclined with respect to said armature shaft in such a way that the gap between said attraction surface of said electromagnet and said reactive surface of said armature is wider at the upper end than at the lower end, upper and lower directions being based upon the direction of a vertical line along which the force of gravity is directed.

2. An electromagnetic device according to claim 1, wherein said armature has a shaft hole formed therein, and said armature shaft has formed therein small diameter portions of smaller diameter than the diameter of said shaft hole, and a large diameter portion of slightly smaller than said shaft hole and just fitting said hole, so that said armature is able to incline with respect to said armature shaft.

3. An electromagnetic device according to claim 1, wherein said regulating member is arranged in an axial position of said armature shaft at said armature.

4. An electromagnetic device according to claim 3, wherein said regulating member comes into contact with the axial surface of said armature.

5. An electromagnetic device according to claim 4, wherein said regulating member comes into contact with one side of the axial surface of said armature.

6. An electromagnetic device according to claim 4, wherein said regulating member comes into contact with the top and bottom sides of the axial surfaces of said armature.

7. An electromagnetic device comprising:

(a) an electromagnet having an attraction surface;

(b) an armature having a reactive surface to be attracted to said attraction surface of said electromagnet;

(c) an armature shaft supporting said armature in such a way as to be able to incline with respect to the axis, and arranged in an inclined relation to said attraction surface of said electromagnet; and (d) a regulating member for keeping said armature in an inclined state with respect to said armature shaft in the opposite direction to that in which said armature shaft inclines.

8. An electromagnetic device according to claim 7, wherein said regulating member keeping said armature inclined with respect to said armature shaft in such a way that the gap between said attraction surface of said electromagnet and said reactive surface of said armature is wider at the upper end than at the lower end, upper and lower directions being based upon the direction of a vertical line along which the force of gravity is directed.

* * * * *